United States Patent [19]

Young

[11] Patent Number: 4,852,649

[45] Date of Patent: Aug. 1, 1989

[54] PACKER SEAL MEANS AND METHOD

[75] Inventor: Carter R. Young, Dallas, Tex.

[73] Assignee: Otis Engineering Corporation, Dallas, Tex.

[21] Appl. No.: 247,084

[22] Filed: Sep. 20, 1988

[51] Int. Cl.[4] ..... E21B 33/122

[52] U.S. Cl. ..... 166/189; 166/120; 166/179; 264/146; 264/156; 277/119; 277/125; 277/198; 277/199

[58] Field of Search ..... 166/189, 387, 120, 180, 166/179, 118; 277/1, 117, 119, 120, 123, 125, 209, 212 R, 212 C, 212 F, 193, 197, 198, 199; 285/137.1, 139; 264/138, 145, 146, 152, 154–156

[56] References Cited

U.S. PATENT DOCUMENTS

| | | | |
|---|---|---|---|
| 1,414,402 | 5/1922 | Friedman et al. | 166/189 |
| 2,602,513 | 7/1952 | Conrad et al. | 166/179 |
| 2,624,603 | 1/1953 | Sweet | 166/179 |
| 2,684,119 | 7/1954 | Brown | 166/179 |
| 2,826,254 | 3/1958 | O'Neill | 166/179 |
| 3,046,028 | 7/1962 | Nathan | 277/212 C |
| 3,132,879 | 5/1964 | Lanmon, II | 277/199 |
| 3,167,127 | 1/1965 | Sizer | 166/189 |
| 3,288,218 | 11/1966 | Young | 166/189 |
| 3,346,267 | 10/1967 | Farley | 277/212 C |
| 3,381,752 | 5/1968 | Elliston | 166/120 |
| 3,851,705 | 12/1974 | Jett et al. | 166/120 |
| 4,413,677 | 11/1983 | Perkins | 166/55.1 |
| 4,505,332 | 3/1985 | Mills et al. | 166/120 |
| 4,512,399 | 4/1985 | Gano et al. | 166/120 |

*Primary Examiner*—Bruce M. Kisliuk

*Attorney, Agent, or Firm*—Albert W. Carroll

[57] ABSTRACT

An improved seal element especially for well packers having multiple mandrels, the improvement providing slits therein of various configurations which allow the seal element to be expanded to sealing condition in response to longitudinal compression such that the resultant stresses created within the element body are minimized in that they are substantially evenly distributed therethrough, thus enabling the multiple packer to seal more readily and to withstand greater pressure differentials.

30 Claims, 7 Drawing Sheets

PACKER SEAL MEANS AND METHOD

BACKGROUND OF THE INVENTION

1. Field of the Invention

This invention relates to well tools and more particularly to seal elements for use on multiple packers for wells, such as oil or gas wells, or the like.

2. Related Art and Information

Dually completed wells are so constructed as to permit simultaneous and separate production from two different pay zones. Early dual wells were provided with a single string of tubing and had a single well packer between the two pay zones. The lower zone produced through the tubing and the upper zone produced through the tubing-casing annulus.

Dual completions were later improved to make them easier to control, safer, and more economical. For many years it has been common practice to provide a string of tubing for each of the two pay zones with a packer above each pay zone. Thus, such a well has a single packer between the zones and a dual packer above the upper zone. The short string of tubing extends down through the upper packer to conduct flow from the upper zone to the surface. The long string of tubing extends down through both packers and conducts flow from the lower zone to the surface.

In a similar manner, a triple completion is constructed to produce from three zones simultaneously and has three packers (a single, a dual, and a triple). Quadruple completions may be similarly constructed with four tubing strings and four packers: a single, a dual, a triple, and a quadruple. Quadruple completions are rare. Triple completions are much less common than duals.

In many cases, the seal elements of dual packers have successfully held only moderate pressures without leaking. It has been desirable to provide seals which would hold much higher pressures without leaking.

Applicant is familiar with the following listed prior patents which disclose dual packers, each being hydraulically actuated and each having a central seal element disposed between upper and lower end elements.

| | | | |
|---|---|---|---|
| 3,167,127 | 3,288,218 | 3,381,752 | 3,851,705 |
| 4,413,677 | 4,505,332 | 4,512,399 | |

U.S. Pat. No. 3,167,127 which issued to Phillip S. Sizer on Jan. 26, 1965; U.S. Pat. No. 3,288,218 which issued to Carter Young on Nov. 29, 1966; U.S. Pat. No. 3,381,,752 which issued to Thomas L. Elliston on May 7, 1968; U.S. Pat. No. 3,851,705 which issued to Marion Barney Jett, et al, on Dec. 3, 1974; U.S. Pat. 4,413,677 which issued to Donald H. Perkins on Nov. 8, 1983; U.S. Pat. No. 4,505,332 which issued to Aubrey C.Mills, et al, on Mar. 19, 1985; and U.S. Pat. No. 4,512,399 to John C. Gano and Donald H. Perkins on Apr. 23, 1985, each show a hydraulically actuated dual packer on which is mounted a set of packer seals. This seal set consists of three elements: a central dual element between an upper and a lower end element. These seal sets are obviously well known and have been in use for years, and are of a type which has been known to leak at much lower pressure than has seemed reasonable.

The present invention is an improvement over such seal sets, which improvement enables the seal elements to seal more readily and hold much greater pressure differentials than heretofore. This improvement therefore overcomes a problem which obviously has existed for many years, and does so at very little additional cost. This improvement can eliminate many costly packer failures. Thus it fills a long-felt need in the oil and gas industry.

SUMMARY OF THE INVENTION

The present invention is directed toward improved seal means for multiple packers which comprises a center seal element for use between an upper and a lower end element, the center element being improved in a manner providing means which enables it to function better with the end elements to be better able to withstand great differential pressures acting thereacross. More explicitly, seal element of this invention is provided with slits means which are so arranged that they enable the elastic material, of which the seal element is made, to respond readily to longitudinal compressive forces and expand laterally to sealing position against the inner wall of a surrounding pipe, such as well casing. At the same time, these slit means are effective to minimize the internal stresses created by such distortion and, thus, lends more uniform support to the end elements to enable them to seal and hold against much higher pressure differentials then previously thought possible.

None of the prior art with which applicant is familiar shows such means for performing such function and enhancing the sealing and holding ability of such packer elements for multple packers.

OBJECTS OF THE INVENTION

It is therefore one object of this invention to provide an improved seal element for multiple packers which has means for minimizing the internal stresses created therein by compressing the element longitudinally to expand it laterally into sealing position.

Another object is to provide such a seal element in which the internal stresses are substantially evenly distributed therein.

Another object is to provide a seal element stack of three elements for use on multiple packers, the element stack comprising upper and lower end elements with a center element disposed between them, the center element being adapted for evenly loading the end elements to enable them to more readily seal against high pressures.

Another object is to provide various ways of forming slits in multiple seal elements to enable them to be deformed such that their internal stresses will be more evenly distributed therein and will thus be minimized.

Another object is to provide such seal elements having slits therethrough which allow slippage of the seal material such that the internal stresses spread evenly through the seal element.

Another object is to provide seal elements for multiple packers having slits therein which open into the bores for the mandrels to allow slippage and thus permit internal stresses to become more evenly distributed through the element.

Another object is to provide seal elements of the character just described wherein the slits are closed at the ends and do not open into the bores for the mandrels.

Another object is to provide methods of making such seal elements having such slits for minimizing and evenly distributing internal stresses created therein upon the element being expanded to sealing condition.

Another object is to provide multiple seal elements which are easier to install on well packers.

Other objects and advantages will become apparent from reading the description which follows and from studying the accompanying drawing wherein:

DESCRIPTION OF THE PREFERRED EMBODIMENTS

Figure 1:
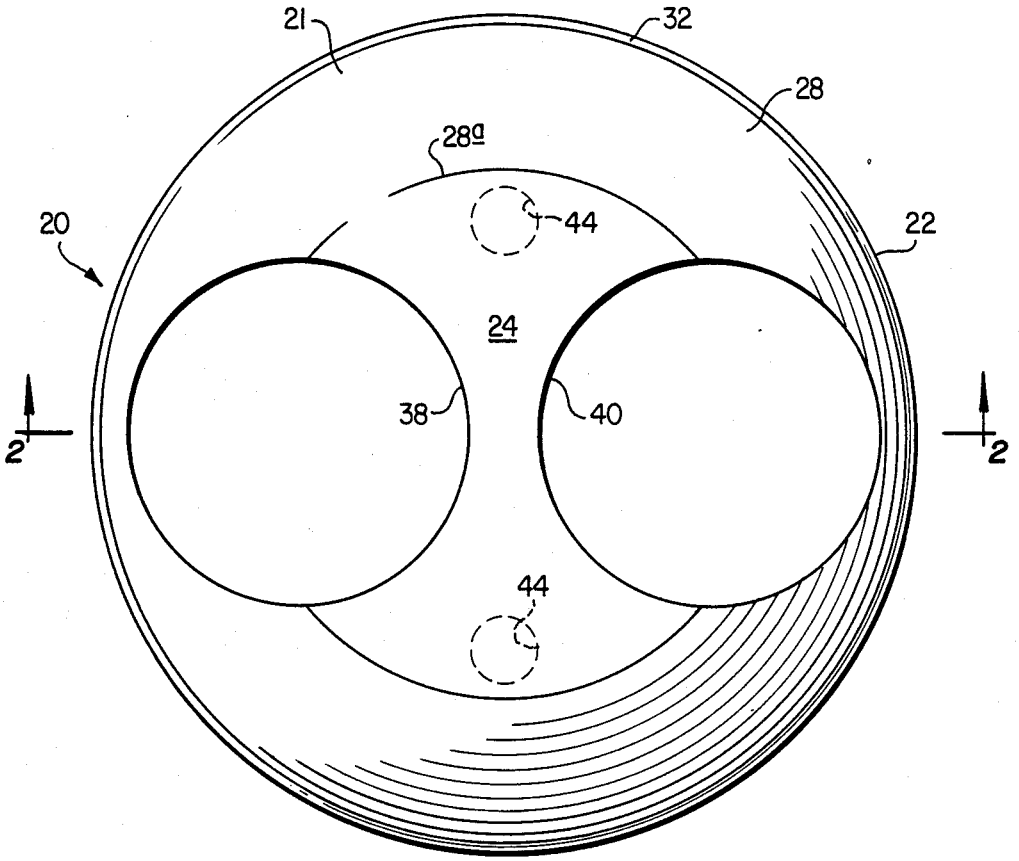
FIG. 1 (PRIOR ART)
FIG. 1 is a top view of a well known packer seal element.
Figure 2:
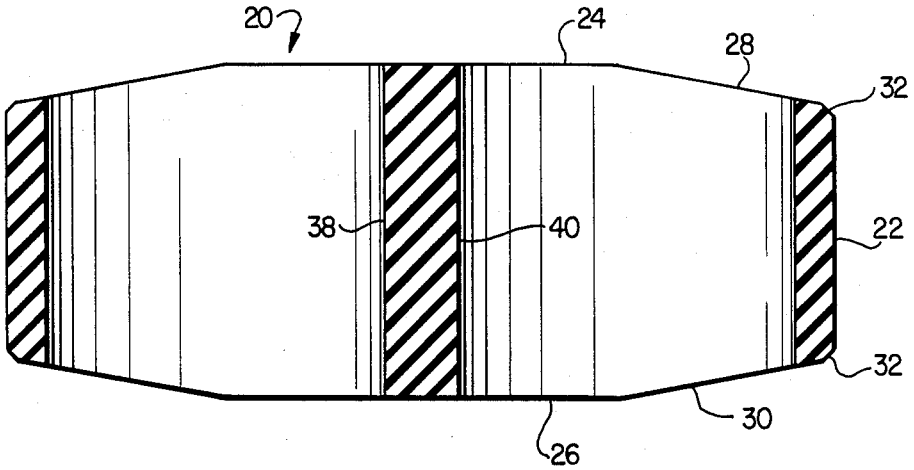
FIG. 2 (PRIOR ART)
FIG. 2 is a longitudinal sectional view taken along line 2—2 of FIG. 1.

Referring now to FIGS. 1 and 2, it will be seen that a prior art seal element 20 is illustrated. This seal element is made of a body 21 haivng an outer cylindrical surface 22 and upper and lower faces 24 and 26. These upper and lower faces are formed with chamfers 28 and 30, respectively. Reference numeral 28*a* identifies the circular line which represents the inward limit of chamfer 28. A narrow bevel is formed on the upper and lower corners as at 32 to protect the body and to provide a guide surface for running the element into a well. The seal element 20 is also provided with a pair of longitudinal bores 38 and 40 as shown. (In some cases, a seal element of this type may be provided with a pair of small bores 44 as shown in dotted lines through which communication tubes might extend in order to conduct fluid pressure from beneath the packer to a location thereabove in order to supply such fluid pressure to hold down buttons which are well known in the art of well packers.)

The seal element 20 is used generally on dual packers for wells and is used between similar upper and lower seal elements which conform thereto thus forming a seal element stack. The purpose of the seal elements, of course, is to form a seal or bridge between the dual mandrels and the inner wall of the well casing.

Figure 3:
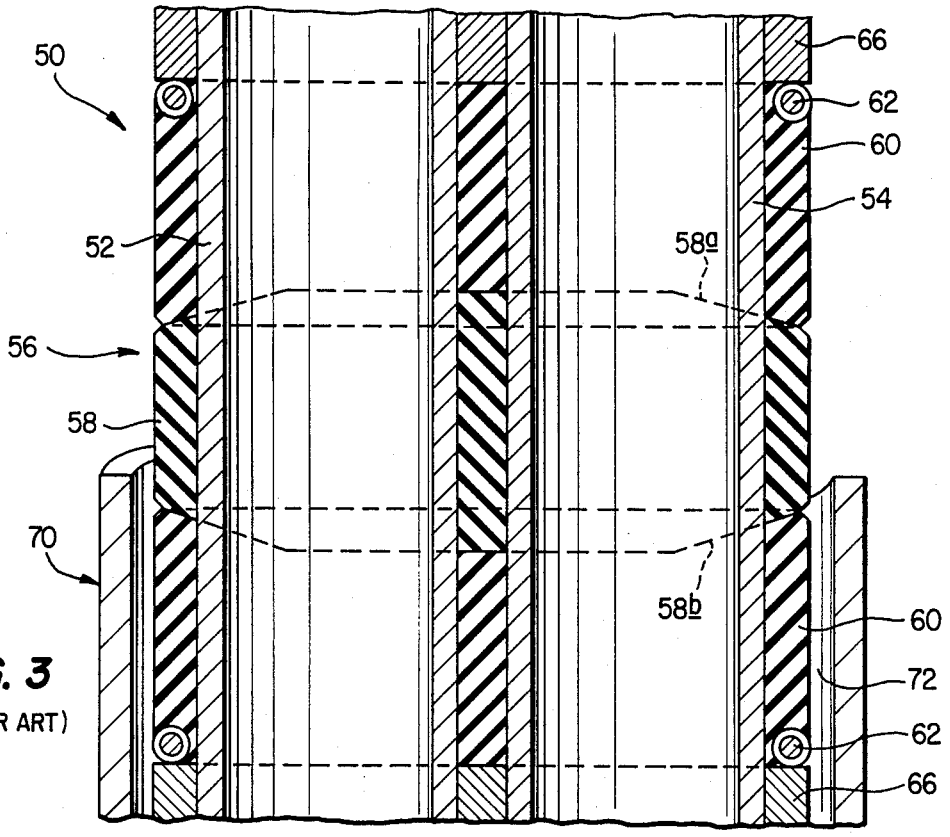
FIG. 3 (PRIOR ART)
FIG. 3 is a fragmentary longitudinal sectional view showing a dual well packer with a set of three seal elements thereon as it is being lowered into a well casing.

Referring now to FIG. 3, it will be seen that a prior art packer 50 is provided with a pair of mandrels 52 and 54 about which is disposed a prior art seal element stack 56 comprising a central seal element 58, which may be identical to seal element 20 of FIG. 1 and 2. Seal element 58 is disposed between upper and lower end elements 60, as shown, the end elements being identical. The end elements are provided at their outer ends with garter type springs 62 which are molded into the polymeric material and function to prevent the polymeric material from being extruded when subjected to differential pressures. Whereas the center element 58 is chamfered on its upper and lower sides as at 58*a* and 58*h*, the upper and lower end elements 60 are shaped to conform thereto. This is clearly shown in FIG. 3 in dotted lines.

The dual packer 50 is shown in FIG. 3 as it is being run into the well through the casing 70. In this condition, the seal elements are relaxed, the packer being not as yet actuated.

Figure 4:
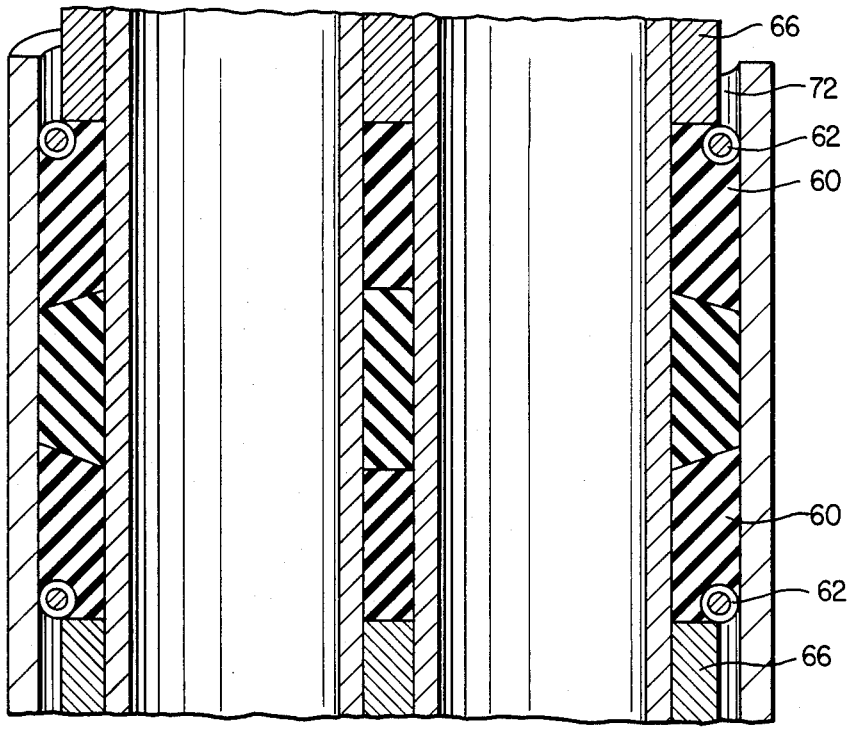
FIG. 4 (PRIOR ART)
FIG. 4 is a view similar to FIG. 3 showing the packer of FIG. 3 with its seal elements expanded to seal between the packer and the well casing.

The packer 50 is shown in FIG. 4 in the actuated condition. The members 60 adjacent the end elements 60 have been forced closer together, thus applying a longitudinal force to the element stack 56. This longitudinal force compresses the seal element stack longitudinally and causes it to expand laterally. As the element stack expands, it closes the gap 72 between the packer and the inner wall of the casing 70, and this longitudinal force must be sufficiently great to build up stresses within the polymeric material of the seal element stack to a value exceeding the value of the pressure differentials which are to be withstood. Otherwise, the elements will leak.

As seen in FIG. 4, the garter type springs 62 in the end elements are in a position to minimize extrusion of the end elements into the gap 72 between the packer and the inner wall of the casing above and below the element stack.

While the center element has been shown to be chamfered at 28 and 30 and the end elements have been made to conform with the upper and lower surfaces of the center element, it is well known to use center elements together with end elements which are not provided with such chamfers. Center elements are often softer than the end elements.

In addition, it is well known not only to use a dual sealing element on dual packers but is also known to use similar elements with packers which have more than two mandrels.

Since most multiple packers are of the dual type, there are been more difficulty with getting the dual packers to seal.

Figure 5:
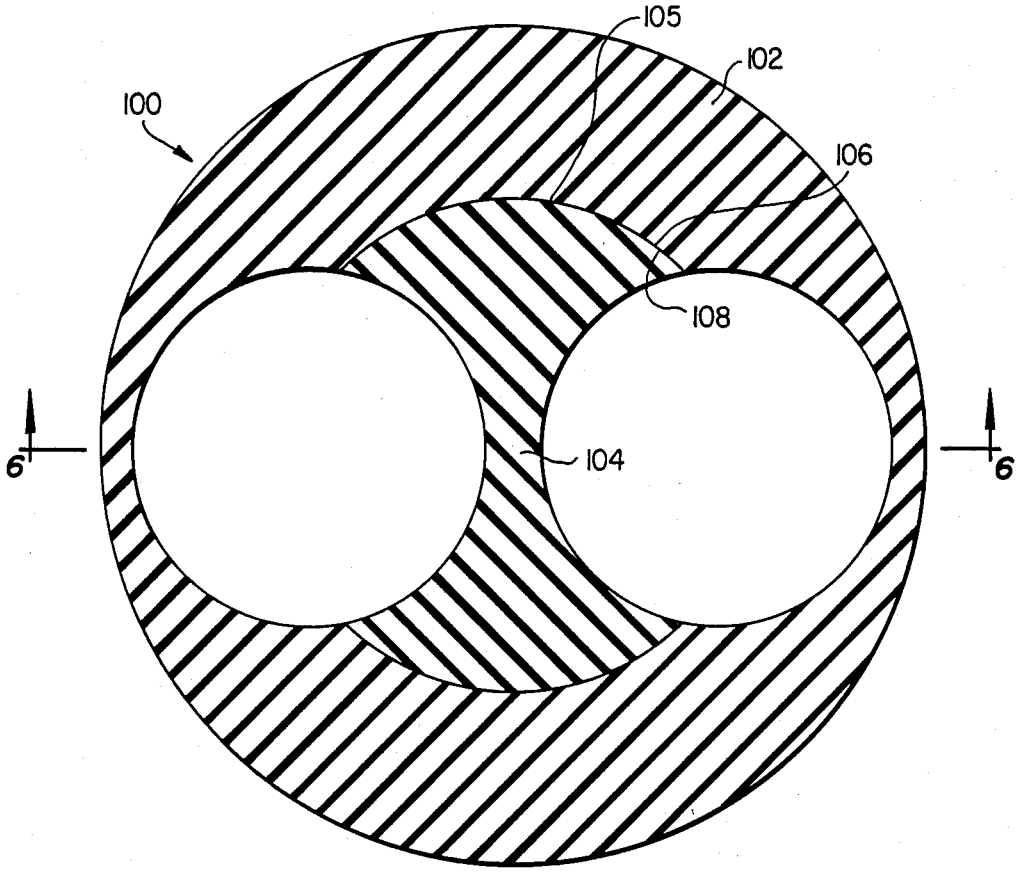
FIG. 5 is a cross-sectional representation of a two-piece dual packer seal element which embodies the present invention.

Referring now to FIG. 5, it will be seen that an improved seal element 100 is illustrated. The seal element 100 is in all respects exactly like the seal element 20 of FIGS. 1 and 2 with one exception. It will be noticed that the seal element 100 is in two pieces, an outer member 102 and an inner member 104. These two members provide an interface 105 between them, as shown. The inner member has an outer edge 106 and the outer member has an inner edge 108. It is interesting to note that in this illustrated version, this interface 105 falls along the line 28a in FIG. 1 which happens to be the line provided by the runout of the chamfer 28. It just so happens that this line 28a is in a suitable place for separating the seal element into two members. This interface 105 provides for slippage between the outer edge 106 of the core 104 and the inner edge 108 of the outer member 102.

Figure 6:
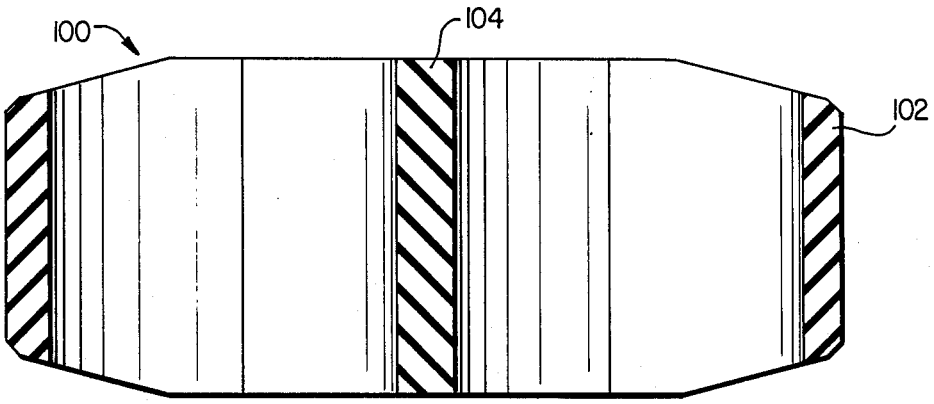
FIG. 6 is a longitudinal sectional view taken along line 6—6 of FIG. 5.

It will be noticed in FIGS. 5 and 6 that the element 100 is shown with the two members cross-hatched differently. This has been done for contrast only since the element could be molded in one piece in the conventional manner and latter cut into two pieces as shown, or it could be molded in two separate pieces and later assembled, as shown in FIG. 5.

Laboratory tests have shown that an element such as element 100 will seal more readily without leaking than is usually the case. There is an indication that the seal element 20, when expanded, has internal stresses which are not well distributed and are therefore much higher in some areas than they need to be. The ideal case, obviously, would be to have the internal stresses as equal in value as possible throughout the element body. Thus, by more evenly distributing these internal stresses, they can be minimized. Excessively high stresses are cause failure of the seal element.

The slit 105 which separates element 100 into inner and outer members is arcuate or curved and substantially follows an arc whose center substantially coincides with the center of the element and has a radius equal to about 50 to 70 percent that of the radius of the element.

Figure 7:
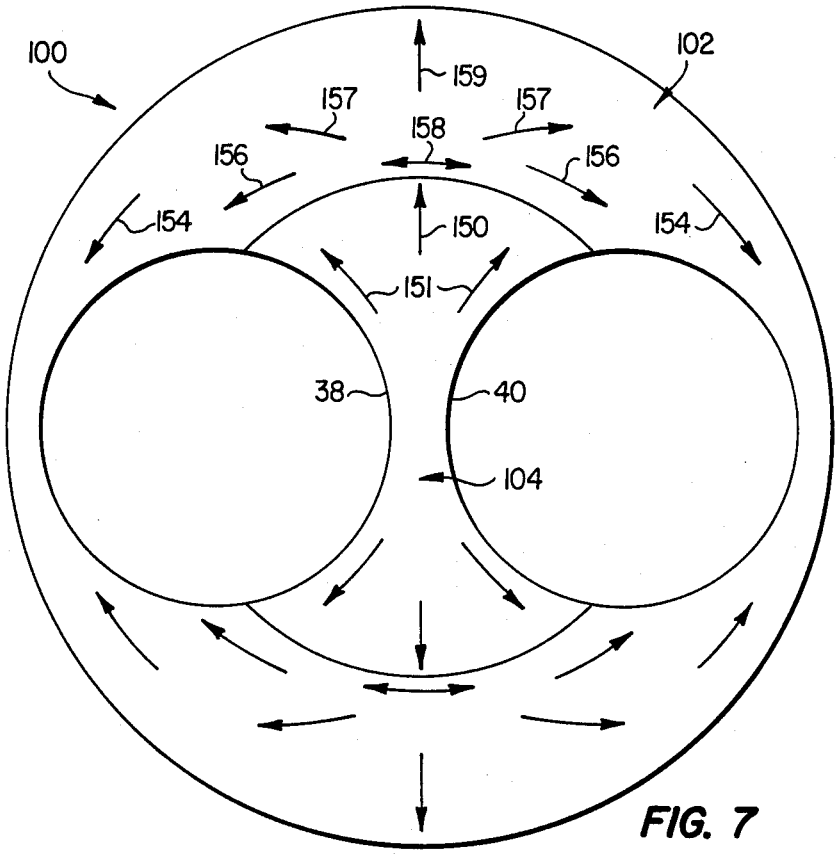
FIG. 7 is a representation of the seal element of FIGS. 5 and 6 with arrows indicating approximate directions of flow of the seal material as the seal element is expanded.

The uneven distribution of stresses within a dual seal element such as seal element 100 may be explained with respect to FIG. 7. In FIG. 7, arrows have been applied to indicate the approximate directions in which the polymeric material of the element may be expected to flow in order to expand and bridge the gap between the packer mandrels and the inner wall of the casing in order to effect a good seal and have the stresses therein well distributed. Looking now at the upper half of the seal element 100, it will be seen that as the element expands laterally in response to being compressed longitudinally, the polymeric material of the inner member 104 can only expand generally upwardly and spread to the upper right and the upper left as indicated by the arrows 150 and 151. At the same time, the polymeric material of the outer member 102 must flow approximately in the directions shown in order for the stresses to be distributed substantially evenly therethrough. Thus, arrows 154 indicate that materials must flow toward the thin part of the element because although the element is at its thinnest there, the gap between the element and the inner wall of the casing is the same as elsewhere around the packer. Therefore, considerable material must flow in that direction and this is indicated by the arrows 156, 157 and 158. The arrow 159 indicates that some of the polymeric material must flow outwardly as seen in FIG. 7.

It is noted in FIG. 7 that the arrow 158 shows the material in this area flows in opposite directions, so the right and left while immediately adjacent this areas, the arrow 150 shows that the material must move upwardly at the same time. Thus, there is a tendency for the element to flow in three conflicting directions. This will obviously build up abnormal stresses within the packer element, since the gap between the packer and the wall of the casing is the same all the way around it, and since the polymeric material is thin at the right side and the left side due to the placement of the holes 38 and 40 for the packer mandrels. It is readily seen that considerable material must flow into the thin areas from elsewhere. The bulk of the material is in the area the arrows 105 and 158. Therefore, since the material has the tendency to flow in two or three directions at once, it must take a long path in its attempt to flow into the areas where needed. Thus it can be readily seen that the polymeric material in the area of the arrows 150 and 158 must be compressed more to force it to flow against such struggle. Consequently, the internal stresses there will be considerably higher than the stresses in the polymeric material at the left and right sides of the element 100 as seen in FIG. 7. This presents a problem inasmuch as these uneven stresses unevenly load the end elements 60 seen in the seal element stack of the FIGS. 3 and 4 so that the element cannot withstand as much pressure as it could it the stresses were distributed evenly. Another problem may arise in that the end elements may not expand evenly about the packer and therefore, may not be in perfect concentric position to hold high pressures.

Referring again to to FIG. 7, if the seal element 100 as illustrated is compressed longitudinally and expanded laterally in order to cause the element to effect a seal between the packer and the casing, the fact that the element is formed in two pieces (outer and inner members 102 and 104) permits relative movement between them. This relative movement occurs at the interface (see interface 105 in FIG. 5) rather than creating excessively high stresses in the seal element body. Thus, the polymeric material can move in the approximate directions shown by arrows 156 relative to the outer edge of the core 104 and thus permit the polymeric material to flow more readily toward the thin part of the element. It also allows the core 104 to expand toward that same area, more or less, since the stresses in the area of the arrows 156 are not unduly high. In this manner, the stresses are more evenly distributed through the seal element 100. Thus, this seal element not only readily effects an initial seal with the well casing, but it lends even support to the end element, enabling it to more readily seal and to hold against pressure differentials.

It is readily understood that when the element 100 is assembled on the packer, oil, or preferably grease, or other suitable lubricant, may be applied at the interface between the inner and outer members 104 and 102 so that slippage as just described will be aided and the internal stresses created by the compression of the element will be minimized.

Figure 8:
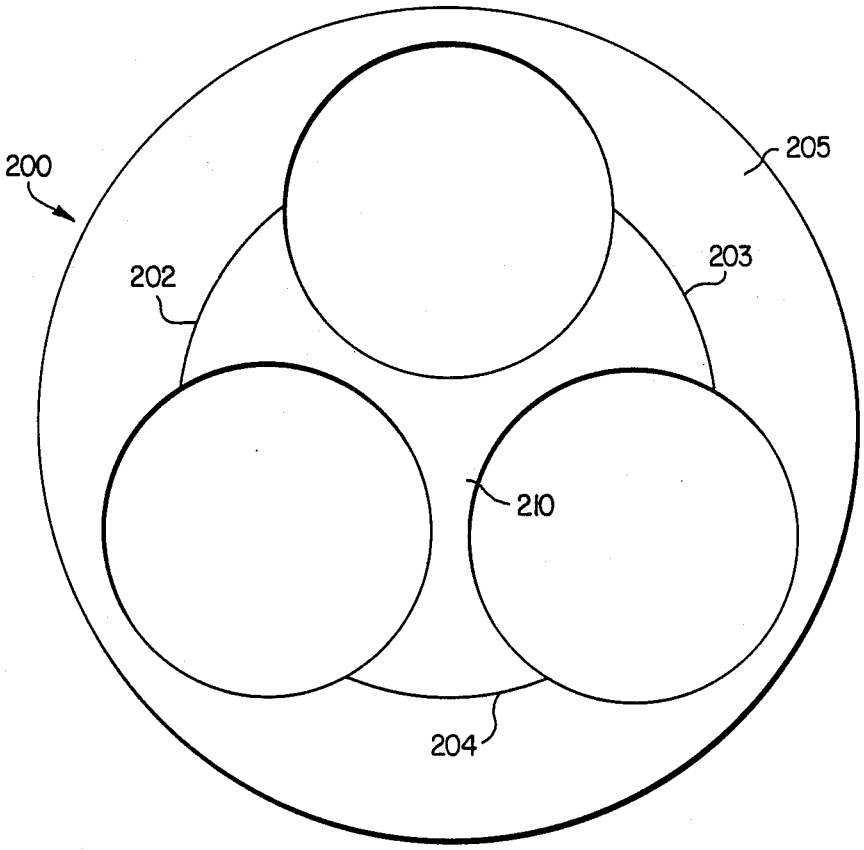
FIG. 8 is a representation of a one-piece triple seal element wihch embodies the present invention.

Referring now to FIG. 8, it will be seen that a seal element for a triple packer is illustrated and is indicated by the reference numeral 200. It may be readily seen that the problems relating to the poor distribution of stresses in the polymeric material of this element will not be so severe as the problems experienced with the dual elements described previously, but if desired, the triple elements can be treated in the same manner as that described previously for the dual element. Thus the element 200 may be cut to provide slits along lines 202, 203 and 204, as shown or, the element may be molded in order to provide two separate pieces, the outer member being identified by the reference numeral 205 and the inner member being indicated by the reference numeral 210. Thus, when the element is compressed longitudinally and caused to expand laterally in response thereto in order to seal between the packer and the well casing, the polymeric material from which it is molded will be able to slide at these slits (202, 203 and 204) in order to equalize or minimize the stresses created in the element in the same manner as was explained hereinabove with respect to the dual element 20 or 100 shown in FIGS. 1, 2, 6 and 7.

Slits 202, 203 and 204 of element 200 are arcuate and follow a path substantially along arcs having a center coincident with that of the element and having radii equal to about 50 to 70 percent that of the element.

Figure 9:
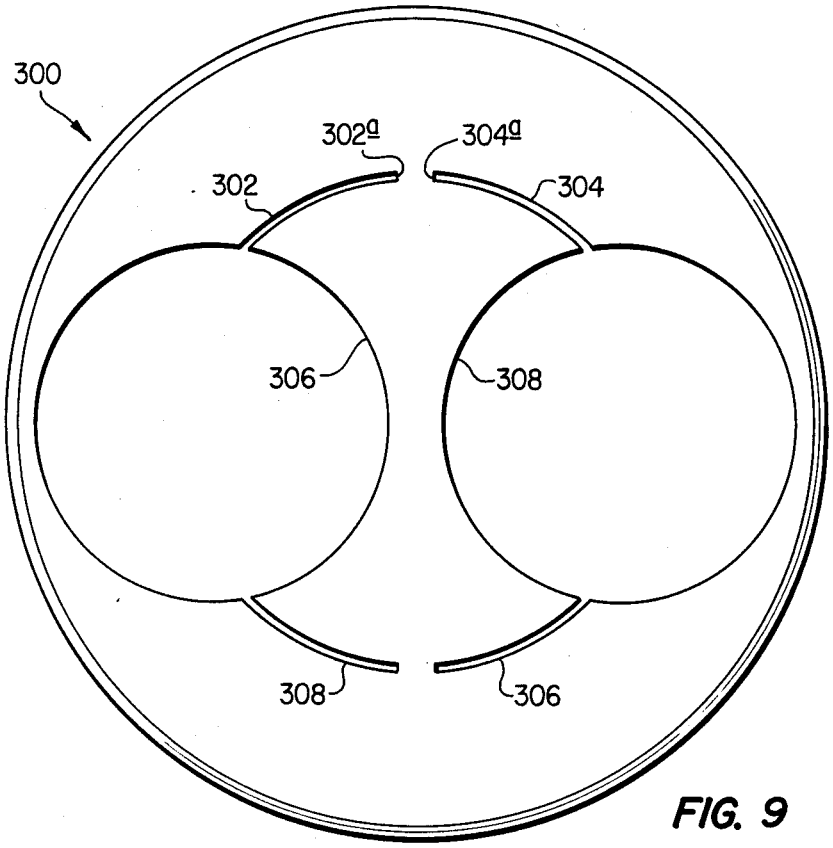
FIG. 9 is a representation of another form of dual seal element embodying the present invention.

Referring now to FIG. 9, it will be seen that a dual element 300 is illustrated. This element 300 is very much like the element 100 illustrated in FIGS. 5–7, with the exception that the element 300 is a one piece element having arcuate slits 302, 304, 306 and 308, as shown. It will be noticed that slit 302 opens into bore 306 and that slit 304 opens into bore 308 while their opposite ends **302*a* and 304*a* do not meet. Therefore the element remains in one piece. However, the slits 302 and 204, as well as slits 306 and 308, are sufficiently long so that the stresses created by the longitudinal compression and lateral expansion will be relieved or will be distributed substantially evenly through the element in the manner explained earlier. Thus, this element will act almost exactly like the element 100 described previously. The gap between slit ends 302*a* and 304*a*** can be sized as desired, probably one-eighth to three-eights inch (3 to 9 milimeters) should be suitable in most cases.

The slits 302, 304, 306 and 308 formed in element 300 are arcuate and follow substantially along arcs which have a center coincident with that of the element and having radii equal to about 50 to 70 percent that of the element.

Figure 10:
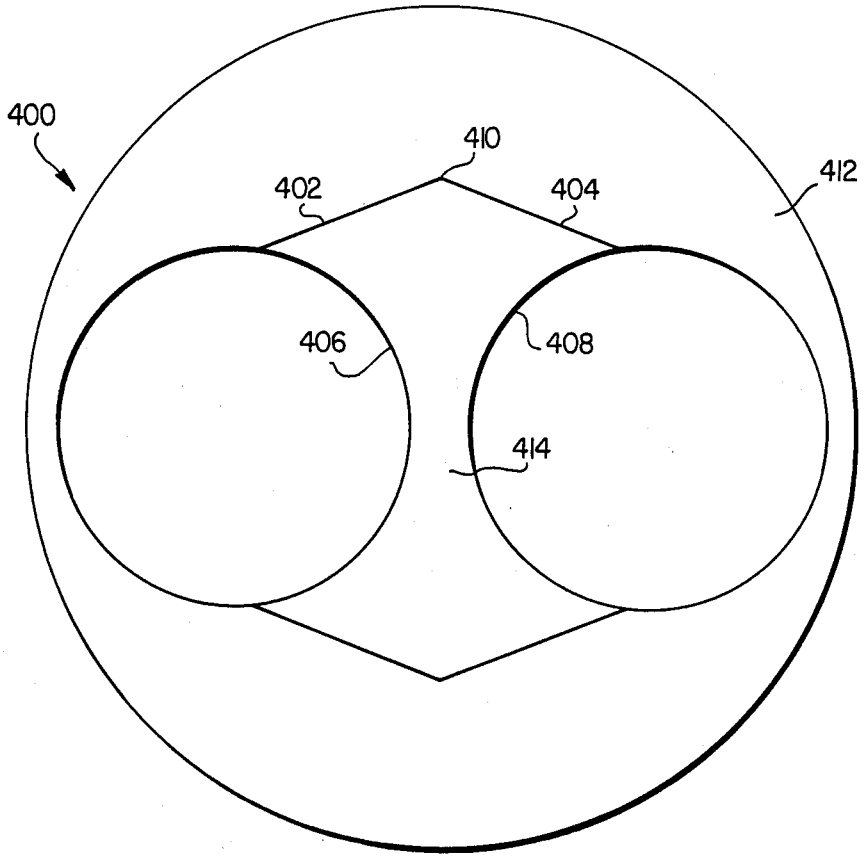
FIG. 10 is a representation of another two-piece seal element which embodies the present invention.

Referring now to FIG. 10, it will be seen that a dual element 400 is illustrated and that this element is very much like the element 100 previously described, but rather than the slit being arcuate, straight slits are provided in the element as at 402 and 404 so that one end of slit 402 opens into bore 406 while one end of the slit 404 opens into bore 408. The opposite ends of the slits intersect at the apex 410 and this, of course, causes the element to be separated into two pieces. The outer member is indicated by the reference numeral 412 and the inner member is indicated by the reference numeral 414 as shown. The slits 402 and 404 perform the same function as do the slits 302 and 304 in element 300 and perform that function in the same manner.

The slits 402 and 404 each substantially follow the path of a broken line having two segments, each segment forming a chord of one-half an arc having a radius equal to about 50 to 70 percent of the distance from the center of the seal element to its outer edge.

Figure 11:
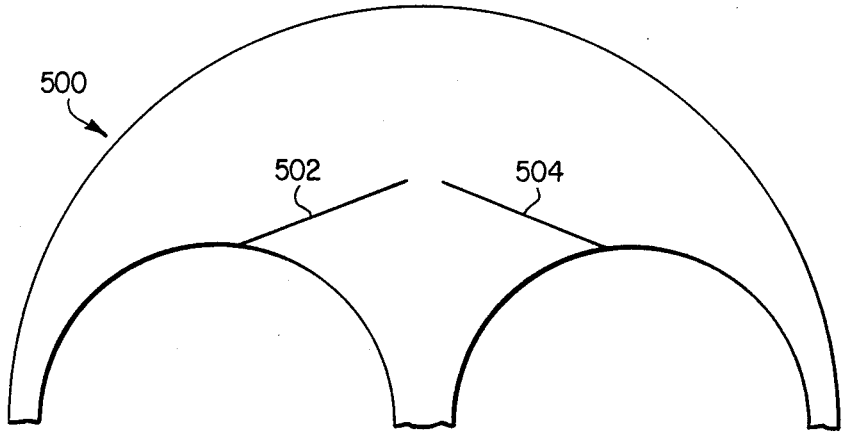
FIG. 11 is a representation of a dual seal element similar to that of FIG. 10, but of one-piece construction.

Referring now to FIG. 11, it will be seen that a dual element 500 is illustrated and that this element is very much like the element 400 just described with the exception that the slits 502 and 504 do not intersect. Therefore the element remains in one piece.

The slits 502 and 504 formed in element 500 substantially follow the path of a line forming a chord of about one-half an arc extending between adjacent holes for mandrels and having a radius equal to about 50 to 70 percent of the distance between the center of the seal element and its outer edge.

The slits 502 and 504 formed in element 500 perform the same function as do the slits 402 and 404 in element 400, and perform that function in the same manner.

Figure 12:
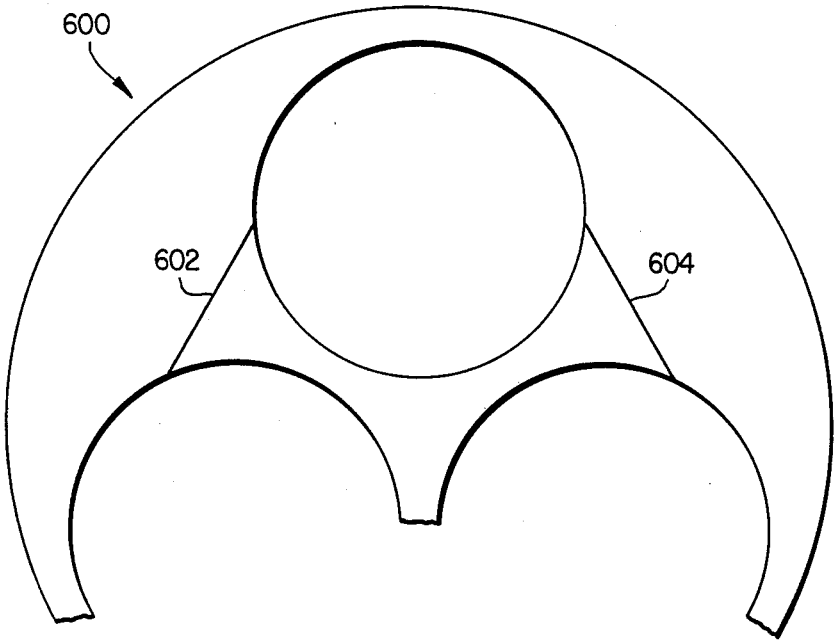
FIG. 12 is a fragmentary representation of a modified form of triple seal element which embodies the present invention.

Referring now to FIG. 12, a seal element 600 is seen to be provided with three bores for mandrels. This element favors very much element 200 of FIG. 8 but has straight slits, such as slits 602 and 604 instead of arcuate slits. Slits 602 and 604 substantially follow the path of a line forming a chord of an arc extending between adjacent holes and having a center coincident with that of the element and having a radius equal to about 50 to 70 percent of the distance between the center and the outer edge of the element.

The slits 602 and 604 of element 600 perform the same function as do the slits 202, 203 and 204 of element 200 of FIG. 8 and perform that function in the same manner.

The seal elements discussed hereinabove and illustrated in FIGS. 5–12 (seal elements 100, 200, 300, 400, 500 and 600) have all been provided with slits or cuts which have had at least one of their ends opening into at least one hole for a mandrel. It may be desirable, especially if the entire seal element is to be molded, to mold slits with closed ends thereinto. Such elements are illustrated in FIGS. 13, 14 and 15.

Figure 13:
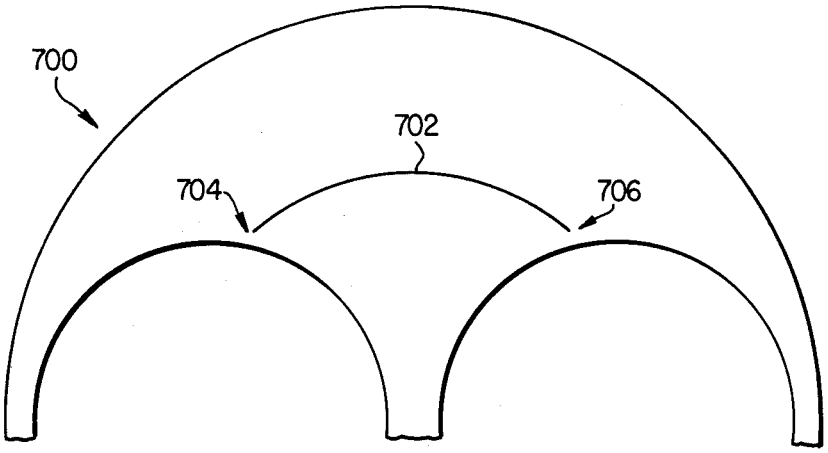
FIG. 13 is a fragmentary representation of a modified form of dual packer element which embodies the present invention.

Referring to FIG. 13, it will be seen that a dual seal element is indicated by the reference numeral 700. Element 700 is provided with an arcuate slit 702 having closed ends as at 704 and 706. This closed-end slit substantially follows a curved path along an arc having a center coincident with that of the element and having a radius about 50 to 70 percent that of the element. It is readily understood that the slit 702 of element 700 will perform the same function as does the slit 105 of element 100 and will perform it in the described manner.

Figure 14:
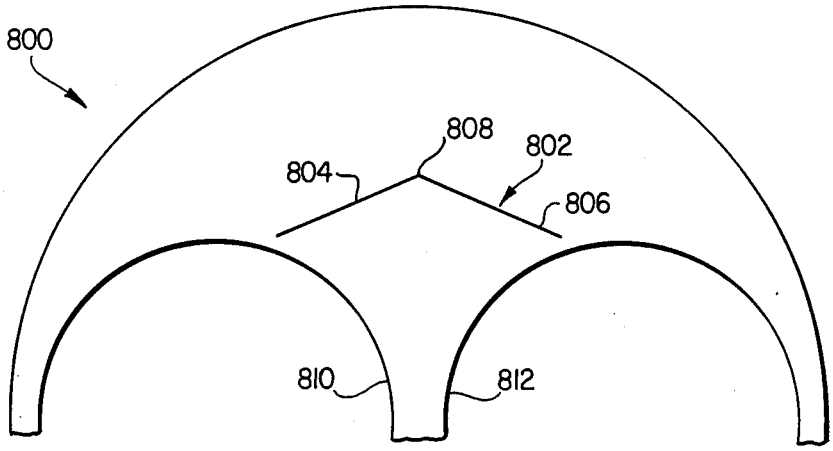
FIG. 14 is a view similar to that of FIG. 13, but showing a slightly different modification in a dual seal element.

In a similar manner, element 800, seen in FIG. 14, is provided with a closed end slit 802 which performs the same function in substantially the same way. Slit 802 has two segments 804 and 806 which converge and intersect at the apex as at 808. The segments 804 and 806 of slit 802 each follow the path of a line forming a chord of about one-half an arc extending between adjacent holes for mandrels 810 and 812 and having a radius equal to about 50 to 70 percent of the distance between the center of the seal element and its outer edge.

Figure 15:
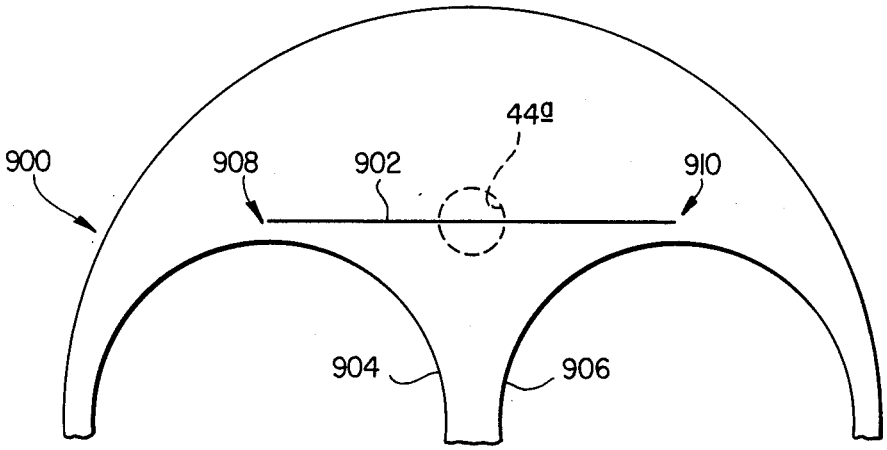
FIG. 15 is a view similar to that of FIG. 14, but showing another slightly different modification is a dual seal element.

Another form of element embodying this invention and having a closed-end slit is seen in FIG. 15. In FIG. 15, the element is indicated by the reference numeral 900 and the slit is indicated by the reference numeral 902.

The slit 902 is located substantially parallel to a plane which is tangent to the bores 904 and 906 and is tangent to an arc having its center coincident with that of the seal element and having a radius equal to approximately 30 to 50 percent of the distance between the center of the element and its outer edge, the length of the slot being approximately equal to the distance between the centers of adjacent holes for mandrels in the seal element.

If the seal element 900 is provided with a hole such as hole **44*a* for accommodating a communication tube, and if hole 44*a* is located as shown, which location is substantially equivalent of the location of hole 44 in seal element 20 of FIG. 1, the slit 902 will very likely open into hole 44**a.

Slit 902 will perform the same function as that performed by the other slits described hereinabove and will perform it in the same way. However, doubtless some of the slits disclosed in this application will perform more efficiently than will others in minimizing internal stresses in their respective seal elements.

It is understood that the slits can be either molded into the elements as the elements are molded, or alternatively, the slits can be formed in the elements after molding by suitable cutting means, such as saws, drills, cutters, or the like.

The foregoing description and drawings of this invention are explanatory and illustrative only, and variations in the sizes and shapes of the slits may be made within the scope of the appended claims without departing from the true spirit of the invention.

I claim:

1. A seal element for use on a multiple packer for sealing between a plurality of mandrels, or similar rod-like members, and the inner wall of a well pipe, said seal element comprising: body means of polymeric material having longitudinal holes therethrough for receiving said mandrels and capable of being distorted into sealing engagement with the inner wall of said well pipe by being expanded laterally in response to being compressed longitudinally, said seal element having a longitudinal axis parallel to said longitudinal holes, said seal element having means for facilitating such lateral distortion while minimizing the stresses created internally of said seal element by such lateral distortion.

2. The seal element of claim 1, wherein said means for minimizing internal success in said seal element is arcuate slit means and include:

(a) a plurality of arcuate slits extending longitudinally through said body means each said slit having a cross section extending in a plane perpendicular to said longitudinally axis, and having a first and a second end limiting such extent, at least one if its end opening into one of said holes for said mandrels.

(b) two such arcuate slits opening into each of said holes for said mandrels, and (c) at least one of said slits extending along a curved path located at least half way out between the center and outer edge of said element.

3. The seal element of claim 2, wherein said slits each have their first end opening into one of the holes for said mandrels but their second ends do not intersect another slit or another hole, leaving the element in one piece.

4. The seal element of claim 2, wherein each of said slits have their first and second ends opening into adjacent holes to separate the element in inner and outer members.

5. The seal element of claim 1, wherein said means for minimizing internal stresses in said seal element is straight slit means and includes:

(a) a plurality of slits passing through said body means and connecting said holes for said mandrels, each end of each of said slits opening into a separate hole for a mandrel, and two of said slits opening into each of said holes for mandrels, (b) said slits each substantially following the path of a broken line having two segments, each segment forming a chord of an arc having a radius equal to about 50 to 70 percent of the distance from the center of the seal element to its outer edge, (c) said slits separating the seal element into inner and outer members.

6. The seal element of claim 1, wherein said means for minimizing internal stresses in said seal element is straight slit means and includes:

(a) a plurality of slits formed through said body means, each slit having one of its ends closed and its other end opening into one of said holes for said mandrels, and two of said slits opening into each of said holes for mandrels, (b) the slits between adjacent holes substantially following the path of a line forming a chord of about one-half an arc extending between adjacent holes for mandrels and having a radius equal to about 50 to 70 percent of the distance between the center of the seal element and its outer edge, (c) said slits stopping short of intersecting at the midpoint of the arc, leaving the seal element in one piece.

7. The seal element of claim 1, wherein said means for minimizing stresses in said seal element include:

(a) a plurality of straight slits passing through said body means, each of said slits having its opposite ends opening into separate ones of said holes for mandrels, (b) said slits substantially following along a path which is tangential to an arc having a radius which is equal about 50 to 70 percent of the distance between the center of the seal element and its outer edge.

8. The seal element of claim 1, 2, 3, 4, 5, 6, or 7, wherein said body is formed with two holes of mandrels.

9. The seal element of claim 1, 2, 3, 4, 5, 6, or 7, wherein said body is formed with three holes for mandrels.

10. The seal element of claim 1, wherein said means for minimizing said internal stresses in said seal element includes a plurality of arcuate slits passing through said body means, the ends of said slits being closed, said slits extending along a curved path located at least half way out between the center and the outer edge of said seal element.

11. The seal element of claim 1, wherein said means for minimizing said internal stresses in said seal element includes a plurality of slits passing through said body means, the ends of said slits being closed, said slits each substantially following along the path of a broken line having two segments, each segment forming a chord of an arc having a radius equal to about 50 to 70 percent of the distance between the center of the seal element and its outer edge, said arc being concentric with said seal element.

12. The seal element of claim 1, wherein said means for minimizing said internal stresses in said seal element includes a plurality of slits straight slits passing through said body means, the ends of said slits being closed, said slits each substantially following a line which is tangent to an arc having a radius equal to about 30 to 50 percent of the distance between the center of the seal element and its outer edge, said arc being concentric with said seal element.

13. The seal element of claim 10, 11, or 12, wherein said body is formed with two holes therethrough for mandrels.

14. The seal element of claim 10, 11, or 12, wherein said body is formed with three holes therethrough for mandrels.

15. A seal element stack for use on a packer for sealing between a plurality of mandrels and the inner wall of a well pipe, said seal element stack including upper and lower end seal elements and a center seal element between said upper and lower end elements, said center seal element comprising: body means of polymeric material having longitudinal holes therethrough for receiving a plurality of mandrels and capable of being distorted into sealing engagement with said well pipe by being expanded laterally in response to compressing the seal element longitudinally, said seal element having means for facilitating such lateral distortion while minimizing the stresses created internally of said seal element by such distortion.

16. The seal element stack of claim 15, wherein said means for minimizing internal stresses in said center seal element is arcuate slit means and includes:

(a) a plurality of arcuate slits in said body means and each having at least one end thereof opening into one of said holes for said mandrels, (b) two of the arcuate slits open into each of said holes for said mandrels, and (c) said slits each extending along a curved path which is at least half way out from between the center to outer edge of said element.

17. The seal element stack of claim 16, wherein said slits have their ends opposite the holes for said mandrels terminated short of connecting with one another, leaving the element in one piece.

18. The seal element stack of claim 16, wherein said slits have their ends opposite the holes for the mandrels connected with adjacent holes to separate the element into two pieces.

19. The seal element stack of claim 15, wherein said means for minimizing internal stresses in said center seal element is slit means which are substantially straight and include:

(a) a plurality of slits passing through said body means and connecting said holes for said mandrels, each end of each of said slits opening into a separate hole for a mandrel, and two of said slits opening into each of said holes for mandrels, (b) said slits each substantially following the path of a broken line having two segments, each segment forming a chord of an arc extending between adjacent holes for mandrels and having a radius equal to about 50 to 70 percent of the distance from the center of the seal element and its outer edge, (c) said slits separating the seal element into inner and outer members.

20. The seal element stack of claim 15, wherein said means for minimizing internal stresses in said center seal element is straight slit means and include:

(a) a plurality of slits formed through said body means, each slit having one of its ends closed and its other end opening into one of said holes for said mandrels, and two of said slits opening into each of said holes, (b) the slits between adjacent holes substantially following the path of a line forming a chord of one half the arc having a radius equal to 50–70 percent of the distance between the center of the seal element and its outer edge, (c) said slits stopping short of intersecting at the midpoint of the arc, leaving the seal element in one piece.

21. The seal element stack of claims 15, 16, 17, 18, 19, or 20, wherein said center seal element is formed with two holes for mandrels.

22. The seal element stack of claim 15, 16, 17, 18, 19, or 20, wherein said center seal element is formed with three holes for mandrels.

23. The method of making a seal element for use on a multiple packer for sealing between a plurality of mandrels and the inner wall of a well pipe, said element being distortable into sealing engagement with said well pipe by compressing said element longitudinally, causing it to expand laterally, said element being provided with means for facilitating such distortion while minimizing the internal stresses created in the seal element thereby, said method comprising the steps of:

(a) providing a seal element of a suitable polymeric material, said seal element being of water-like shape having a longitudinal axis and having a plurality of holes extending longitudinally therethrough for receiving a plurality of packer mandrels; and (b) forming means in said seal element for allowing the element to be distorted into sealing position while minimizing the lateral internal stresses created therein by the longitudinal compression and resultant lateral expansion.

24. The method of claim 23, wherein the step of forming said means in said seal element for minimizing the internal stresses created therein as a result of distorting it to sealing position include:

(a) forming a plurality of slits in said seal element, each slit having at least one end thereof opening into one of said holes for said mandrels, (b) each hole having two slits opening thereinto, said slits each extending along a curved path which is located at least half way out from the center to the outer edge of said seal element.

25. The method of claim 24, wherein said slits have their ends opposite the ends which connect but with said holes for said mandrels approaching each other but terminating short of connecting with each other, thus leaving the seal element in a single piece.

26. The method of claim 24, wherein the step of forming said slits in said seal element for minimizing the internal stresses created therein as a result of distorting it into sealing position include: extending such slits until they intersect so that each pair of slits thus connected to each other connect between adjacent mandrel holes, thus separating the seal element into two pieces.

27. The method of claim 23, wherein the step of forming said means in said seal element for minimizing the internal stresses created therein as a result of distorting said seal element to sealing position includes:

(a) forming a plurality of straight slits passing through said seal element, each having at least one end thereof opening into one of said holes for said mandrels, and two such slits opening into each such hole, and (b) each pair of said slits between adjacent holes extending along a path which would cause them to converge at a point at least halfway out from the center of said element to its outer edge.

28. The method of claim 27, wherein the step of forming said straight slits includes ending them prior to their intersecting, thus allowing the seal element to remain in one piece.

29. The method of claim 27, wherein the step of forming said slits includes extending said slits so that each pair of slits between adjacent holes intersect to thus separate the seal element into two pieces.

30. The method of claim 23, 24, 25, 26, 27, 28, or 29, wherein the step of forming said means for minimizing said internal stresses created in said seal element as a result of said distortion is accomplished by molding.

* * * * *